US006711768B2

(12) United States Patent
Maldonado

(10) Patent No.: US 6,711,768 B2
(45) Date of Patent: Mar. 30, 2004

(54) METHOD OF MAKING A THREE-DIMENSIONAL FLOWER PILLOW/ CUSHION

(76) Inventor: Doris Bailey Maldonado, 164 Pledger Harbor Rd., Columbia, NC (US) 27925

( * ) Notice: Subject to any disclaimer, the term of this patent is extended or adjusted under 35 U.S.C. 154(b) by 0 days.

(21) Appl. No.: 10/118,757

(22) Filed: Apr. 8, 2002

(65) Prior Publication Data

US 2003/0188384 A1 Oct. 9, 2003

(51) Int. Cl.[7] ..... A47G 9/00
(52) U.S. Cl. ..... 5/636; D6/601
(58) Field of Search ..... 5/636, 641, 645, 5/951; D6/601

(56) References Cited

U.S. PATENT DOCUMENTS

| | | | | | |
|---|---|---|---|---|---|
| D35,600 | S | * | 1/1902 | Bentley | D6/600 |
| 690,914 | A | * | 1/1902 | Bentley | 5/490 |
| 904,287 | A | * | 11/1908 | Warham | 5/641 X |
| D71,533 | S | * | 11/1926 | Sevier | D6/601 |
| 1,686,247 | A | * | 10/1928 | Murphy | 5/641 |
| 1,719,256 | A | * | 7/1929 | Bernstein | 312/352 |
| 5,299,335 | A | * | 4/1994 | Ivester et al. | 5/641 |
| D353,073 | S | * | 12/1994 | Birk | D6/601 |
| 5,437,070 | A | * | 8/1995 | Rempp | 5/636 |
| D366,176 | S | * | 1/1996 | Gish | D6/601 |
| D397,575 | S | * | 9/1998 | Miller | D6/600 |
| 5,943,975 | A | * | 8/1999 | von Burchard | 5/636 X |
| 6,430,764 | B1 | * | 8/2002 | Peters | 5/641 |
| 6,574,810 | B2 | * | 6/2003 | Mangiaracina | 5/655 |
| 2002/0104166 | A1 | * | 8/2002 | Mangiaracina | 5/655 |

OTHER PUBLICATIONS

Gershman, Maurice, M.D. "Self–Adhering Nylon Tapes." Journal of A.M.A. (vol. 168, No. 7) Oct. 18, 1958.*

* cited by examiner

*Primary Examiner*—Robert G. Santos
(74) *Attorney, Agent, or Firm*—William F. Pinsak

(57) ABSTRACT

A decorative pillow with all the individual proportions of the flower represented by the pillow. Each pillow consists of a center (a), individual petals that are fashioned in the shape of the petals of the flower being duplicated (b), leaves which correspond with each flower (c), a potpourri pouch (d), in which to add potpourri, and a bottom (e).

10 Claims, 18 Drawing Sheets

FIG.1
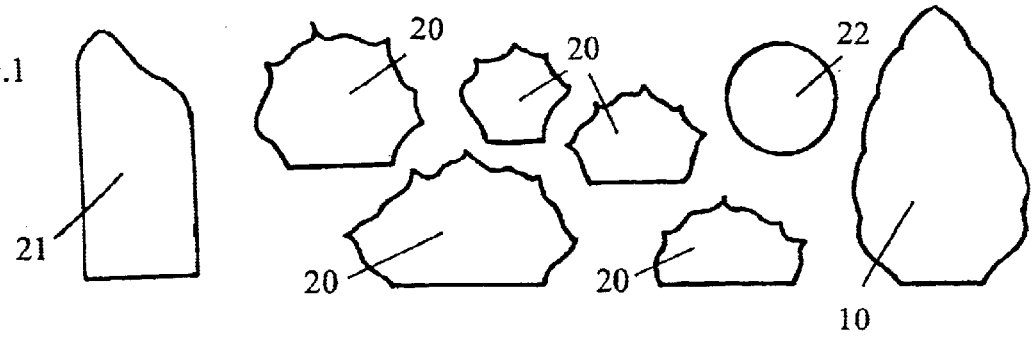
FIG.2
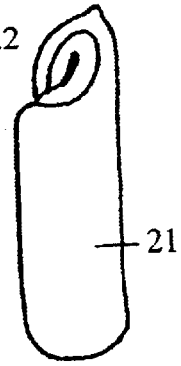
FIG.3
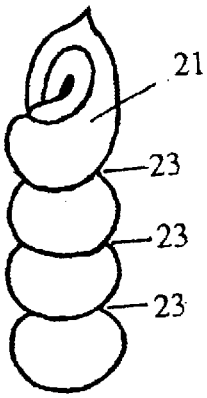
FIG.4
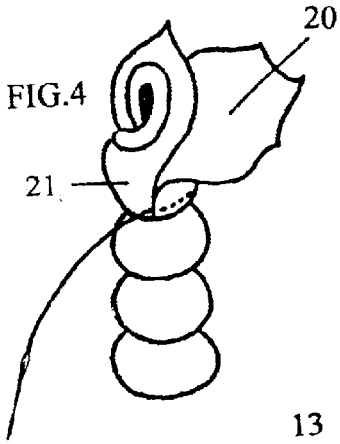
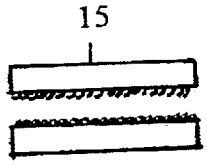
FIG.6
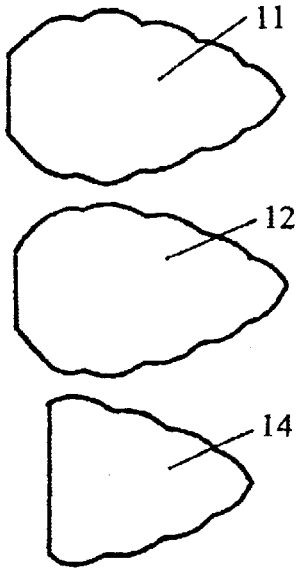
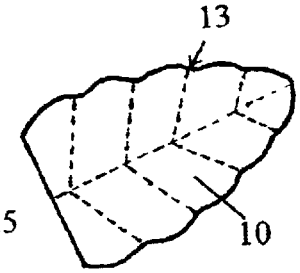
FIG.5

METHOD OF MAKING A THREE-DIMENSIONAL FLOWER PILLOW/CUSHION

BACKGROUND OF THE INVENTION

1. Field of Invention

This invention relates to decorative pillows in the shape of different flowers.

Pillows serve two purposes. They are made either for comfort or for decoration. In recent years these qualities have been combined. The present invention combines these qualities, but also incorporate within these pillows a potpourri pouch. This invention describes a three-dimensional flower shaped pillow with individual petals and leaves. Each flower has two leaves. One leaf on each of the flowers has a potpourri pocket made into the leaf. Each flower has a middle section to which the petals are attached. The petals are arranged according to the way petals are formed on whatever flower is being fabricated.

2. Description of Prior Art

In the past, pillows were used mainly for the purpose of making sleeping more comfortable. Not much thought was given to their looks. They were used solely for comfort. Over the years people have seen the need not only to make pillows more comfortable, but more appealing visually. In doing so pillows are made in many shapes, sizes, and fashions. Some are even fanciful and ornate.

A good example of a fanciful pillow is one made by Ann Gish, U.S. Pat. No. D366176 January, 1996. The shape is round and there are layers of ruffles. This design is simply a frilly version of a pillow. It doesn't look like a real flower, but imitates a fantasy flower, without the features of a real flower. It cannot be used in certain rooms in the home. It would have to be used in a particular setting such as a little girl's room that is decorated with a frilly bedspread and curtains. It would not be appropriate in a living room or family room. It would look out of place. The pillows of this invention on the other hand, look very much like real flowers. The pillows of this invention have all the components of a real flower. These pillows are not limited to a particular room in the home. They can be used in practically any room. They can be used in and out of season. The purpose of these pillows are not only for visual appeal although that is their main purpose, but they are very comfortable as well. They can be used in the same way as any other pillow. They retain their shape when used because they are stuffed with material that allows them to bounce back.

There may be little distinction between pillows and cushions, but Florian Dove Miller, U.S. Pat. No. D397575 September, 1998 has taken cushions to another level. She has fashioned a pillow/cushion to form a rose. It looks very much like a rose, but it does not include leaves. Angelika von Burchard, U.S. Pat. No. 5,943,975 August 1999, has a pillow/cushion that is three-dimensional that has separate components. It imitates a rose but does not have all the components of a real rose. The rose made according to this invention, not only looks like a rose, but it is capable of smelling like a rose. It also has leaves. The leaves are fashioned to look like the leaves of a rose. Flowers should look like flowers whether they are pillows or cushions.

The disadvantage suffered by the prior art three-dimensional flower shaped pillow/cushions are several fold in that they offer beauty only for the sake of visual appeal.

These pillow/cushions are not seasonable. They are made to use whenever visual appeal is desired. They are not multi-functional in that they may be comfortable to lay on, but their main purpose is to look good. These pillow/cushions are not diverse in their styles. They are made in only one particular way to make one particular pillow/cushion. These pillow/cushions do not look like real flowers because they do not have all the components of a real flower.

SUMMARY OF THE INVENTION

The present invention overcomes the shortcomings of the prior art by providing a method for the manufacture of a variety of flower shaped pillows which more closely duplicates the shape, color and odor of actual flowers. More specifically, the invention provides a method of producing petals and leaves peculiar to a variety of flowers and of combining these components into pillows which have the appearance of such flowers. For each flower, at least one of a plurality of leaves is fabricated to form a receptacle for aroma-emitting substances, such as potpourri.

OBJECTS OF THE INVENTION

It is therefore an object of this invention to provide a method of manufacturing multi-petal three-dimensional pillows with visual appeal.

It is a further object of this invention to provide a method of manufacturing multi-petal three-dimensional pillows that look like real flowers.

It is a still further object of this invention to provide a method of manufacturing multi-petal three-dimensional pillows which are not only soft and comfortable but which are capable of retaining their shape after use.

It is yet another object of the invention to provide a method of manufacturing multi-petal three-dimensional pillows which may be used daily or seasonally to reflect the periods of time at which the flowers are in bloom, e.g., mistletoe at year end, dogwood in the spring, lillies at Easter time, roses in the summer, etc., each flower having it's own unique coloration.

Lastly, it is an object of this invention to provide a method of manufacturing multi-petal three-dimensional pillows which incorporate the leaves unique to that particular flower.

Other objects, advantages and novel features of the present invention will become apparent from the following detailed description of the invention when considered in conjunction with the accompanying drawings.

DESCRIPTION OF THE VIEWS OF THE DRAWINGS

FIG. 1 shows necessary pieces needed to make a rose pillow.

FIG. 2 shows the folded middle section of the rose.

FIG. 3 shows the middle section of the rose folded and wrapped with twine.

FIG. 4 shows the smallest rose petal being stitched to the middle section.

FIG. 5 is a top view of a leaf that has been sewn, stuffed and lined with veins.

FIG. 6 is a drawing of the parts necessary to make a leaf with a potpourri pouch on it.

FIG. 47 shows a drawing of a petal with veins sewn in.

BRIEF DESCRIPTION OF THE PREFERRED EMBODIMENTS

Figure 7A:
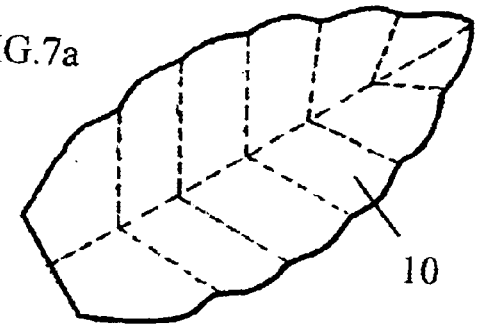
FIGS. 7(*a*)–7(*e*) show a sequential method of adding a pouch on one leaf.
Figure 7B:
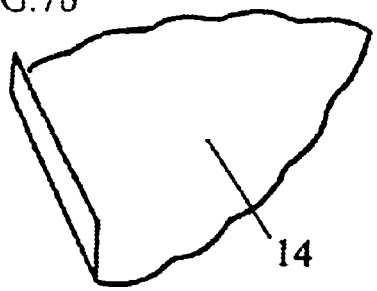
Figure 7C:
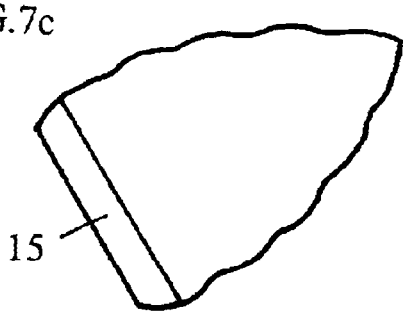
Figure 7D:
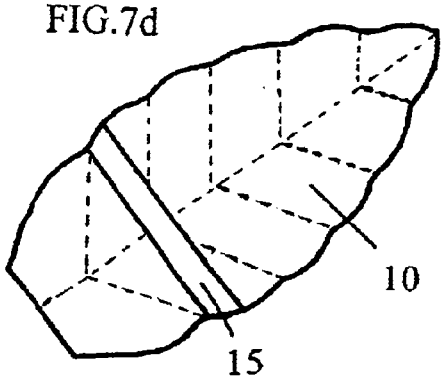
Figure 7E:
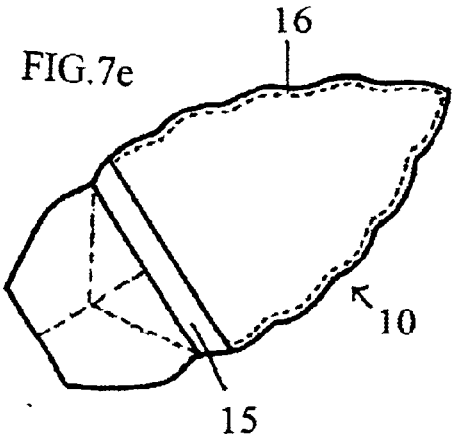
Figure 8:
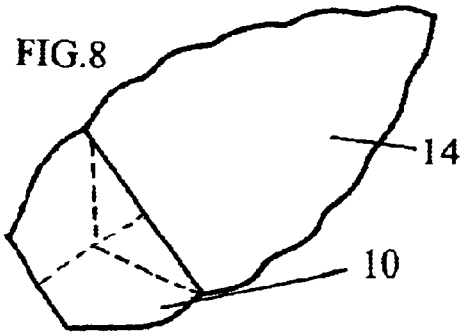
FIG. 8 shows a leaf complete with a potpourri pouch.

Each Perennial Pillow is fashioned in the shape of the pillow it represents. The method of fabrication begins by cutting and sewing each piece separately and putting them together one piece at a time. The center is fashioned first. The petals and leaves are arranged according to those of the flower being imitated. They are then attached to the center. A bottom is added to each pillow for a neat finish.

After being cut out, the petals are sewn one at a time leaving an opening for stuffing. They are then stuffed with a stuffing material such as, but not limited to polyfil, and sewn up. The petals are attached to the center to form the pillow.

The leaves are sewn, stuffed and turned. Next, the veins are sewn in. A pouch is added to one leaf. This is done by marking the leaf where a fastening means such as, but not limited to, a commercially and readily available hook and loop type will be attached.

The fastening means is attached to the leaf and to the pouch section. The pouch is sewn on the side of the leaf opposite the fastener side with the fastener still on the top side of the pouch section. When the pouch has been sewn into place, turn the leaf and the pouch is made.

The pillow is given a smooth finish by adding a bottom. The bottom is sewn and stuffed loosely. It is then attached to the underside of the pillow.

DETAILED DESCRIPTION OF THE INVENTION

The present invention is described hereinafter by a detailed description of the preferred embodiments, which are presented in conjunction with, and by reference to, the accompanying drawings, in which the reference characters refer to like or corresponding parts.

The preferred embodiments illustrated are not intended to be exhaustive or to limit the invention to the precise form disclosed. The method of fabricating flowers having different characteristics and shapes has been chosen and are herein described in order to best explain the invention and its practical utility to enable others skilled in the art to best utilize the invention.

In order to eliminate unnecessary descriptive material and to focus on the invention, the fabrication of the leaves, for each flower will only be broadly explained and described once, as the leaves vary in shape according to each particular flower but are otherwise assembled in like fashion.

It will not be repeated in the description of each individual flower and leaf that the basic materials needed are fabric, thread, scissors and fill material. A skilled artisan will understand that the fabrics will be selected so that they reflect the artisan's interpretation of the most suitable colors befitting a selected flower. The fill material may be natural down fibers, synthetic fibers or polyfil, at the discretion of the artisan.

As previously stated, because the leaves are made in the same fashion for each flower/pillow, the fabrication of a simple leaf will be explained. Each leaf is cut to size and shape befitting the leaves of the flower being simulated. Two leaves are used for each flower.

The first leaf 10, has upper 11, and lower 12, portions, and is fabricated by sewing, turning, stuffing and closing. Veins 13 are then sewn into leaf 10, to simulate the veins in the leaf of the specific flower.

The second leaf is sewn using three sections, as depicted in FIG. 6, top section 11, bottom section 12, and pouch section 14,. Fastener means is also needed for the leaf.

While other fastening means may be used, a hook and loop type fastener 15, such as one sold under the trademark of Velcro is preferred.

Initially, the second leaf is sewn in the same fashion as the first leaf, in that the two same-sized portions 11,12, are sewn together, as shown in FIGS. 7(*a*)–7(*c*). However, seam 16, around the outside is sewn closer to the edge than the seam of the first leaf. As shown in FIG. 6, pouch section 14 of the leaf is shorter than the other two portions.

The bottom of pouch portion 14 of leaf is folded, Fig. 7(*b*), and placed with bottom turned up and with its back to the middle section. One portion of the hook and loop type fastener 15 is attached to the folded over portion. The middle section is thus marked by a suitable implement, such as a sewers marking pencil to indicate the position at which the mating portion of the hook and loop type fastener 15 will be fixed, indicated in FIG. 7*d*. With all three sections of the leaf in place, the sections are sewn together around the periphery of the leaf. The pouch is accordingly completed and the leaf is ready for mounting to the flower, with the pouch facing underneath the flower/pillow.

The following is a preferred embodiment of the method of this invention and is a step by step description of the fabrication of typical seasonal flower/pillows according to this invention.

The basic principle used in making a three-dimensional multi-petal flower shaped pillow in the form of a rose is as follows:

Step 1-Petals, center, leaves and bottom are cut out. The size and shape of the petals will vary as they do on roses. The number of petals used to make the rose is left to the discretion of the individual making the pillow.

Step 2-The petals 20, leaves 10, center 21, and bottom 22, are sewn separately, leaving a hole open for stuffing on each piece. Once each piece has been stuffed, the petals are ready to be put together to form a rose.

Step 3-Starting with the middle of center 21, FIG. 2, fold it over keeping the piece in a vertical position. While center is folded, wrap twine 23 around most of the center starting about one third of the way down the center FIG. 3 Secure the twine.

Step 4-The smallest petal should be used to start making the rose. Slightly above where the twine begins, attach the petal by stitching along the bottom FIG. 4. Place the other petals in order according to size from smallest to largest turning the center in a clockwise position when each petal is added. This is done until a rose is formed.

Step 5-When the rose is satisfactorily formed, the leaves are added.

Figure 9:
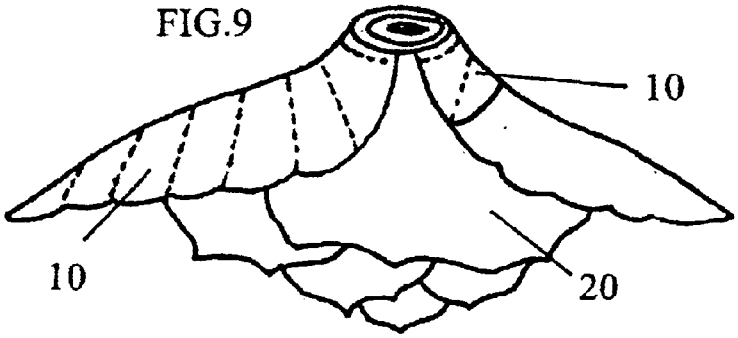
FIG. 9 is an upside down view of the rose showing how to attach the leaves to the rose petals and middle section.

Step 6-Attach the leaves to the rose by sewing them to the middle section FIG. 9.

Once the leaves have been added it is time to complete the pillow by adding the bottom 22.

Figure 10:
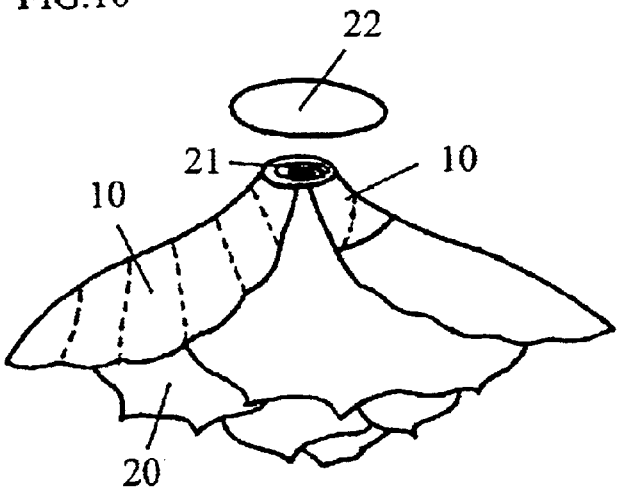
FIG. 10 is an upside down view of the bottom piece being placed on the rose.
Figure 11:
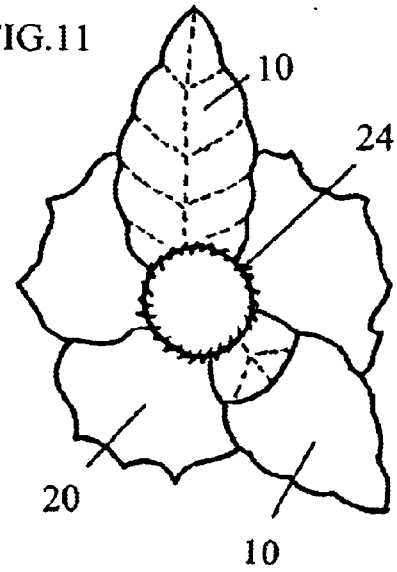
FIG. 11 shows how to stitch the bottom into place.
Figure 20:
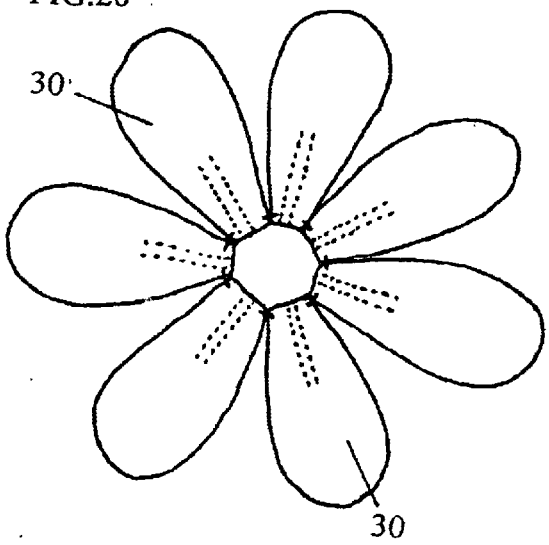
FIG. 20 shows petals tacked together.

Step 7-Bottom 22 should be placed in the center underside of the pillow FIG. 10. Sew into place using an over-stitch 24, FIG. 20.

Figure 12:
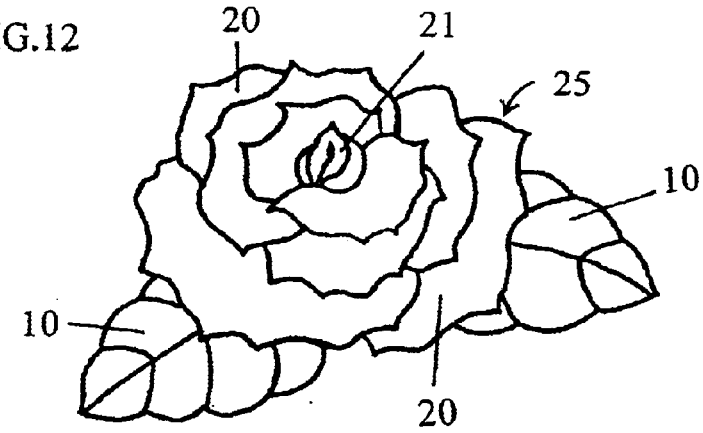
FIG. 12 is a top view of a completed three-dimensional, multi-petal rose pillow.
Figure 13:
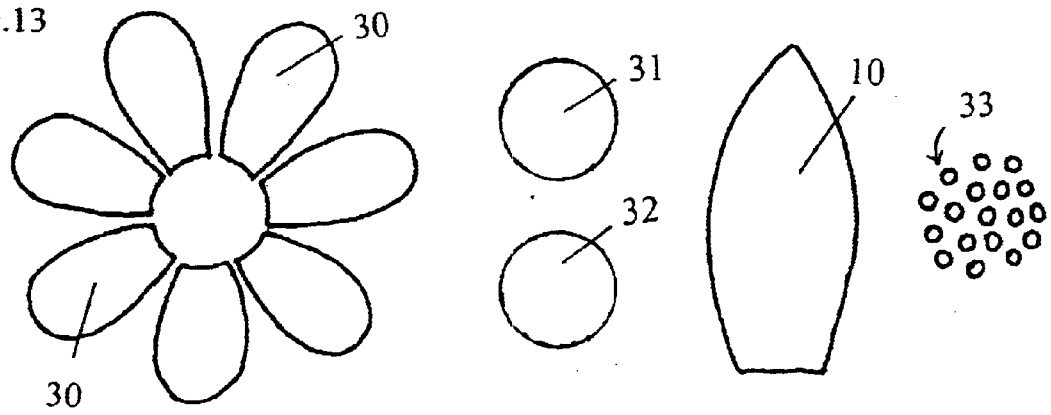
FIG. 13 shows pieces necessary to make a daisy shaped pillow.
Figure 14:
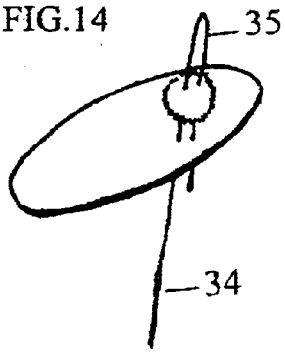
FIG. 14 shows how to attach pom-poms to fabric to duplicate a daisy center.

An example of a three-dimensional, multi-petal rose pillow 25, fabricated in accordance with the method of this invention is illustrated in FIG. 12.

The basic principle used in making a three-dimensional, multi-petal flower shaped pillow in the form of a daisy is as follows:

Step 1-Petals 30, leaves 10, center 31, and bottom 32 are cut out. The size of the flower being made is totally up to the discretion of the individual making the pillow.

Step 2-Sew and stuff center 31 and bottom, 32.

Figure 15:
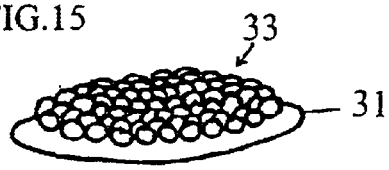
FIG. 15 shows how center should look when completely covered with pom-poms.

Step 3-The topside of center 31 is covered in half inch yellow pom-poms 33. This gives the effect of a daisy middle. This effect is achieved by running a regular sewing needle 34, threaded with yellow 35 thread through the middle of pom-pom 33 and attaching it to the fabric 31. The fabric 31, to which the pom-poms 33 are attached, should be covered leaving a space of about one half inch around the edge FIG. 15. Now the two pieces that make the center can be sewn together.

Figure 16:
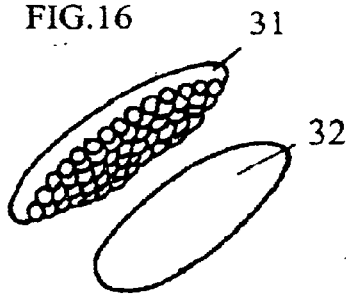
FIG. 16 shows center with pom-poms turned down on top of bottom center.
Figure 17A:
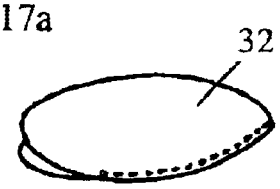
FIGS. 17(*a*) to 17(*c*) are schematic representations, of how the center is put together by sewing, turning and stuffing.
Figure 17B:
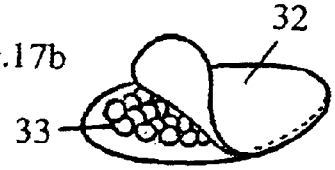
Figure 17C:
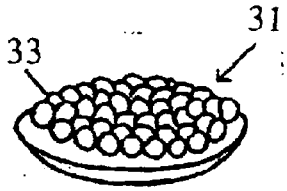

With pom-poms 33 turned on the inside FIG. 16, sew the two pieces of fabric together FIG. 17(*b*), leaving a opening for stuffing FIG. 17(*a*). Turn the fabric so that the pom-poms 33 are on top. Stuff the center and close by sewing FIG. 17(*c*).

Figure 18:
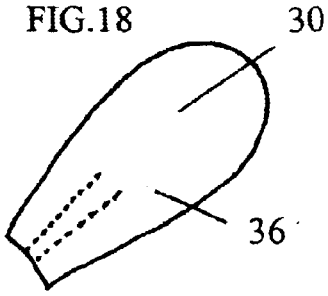
FIG. 18 shows seams sewn down the middle of the petal.

Step 4-The petals are sewn and stuffed. Two seams 36, are sewn down the middle of each petal 30, a few inches from the bottom of the petal FIG. 18.

Step 5-Two leaves 10 are shaped according to the shape of the leaves on a daisy. The leaves are fashioned in the same manner as described previously.

Figure 19:
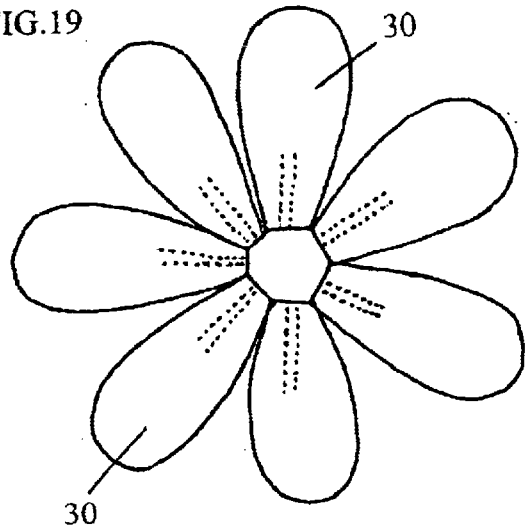
FIG. 19 shows how to arrange flower petals so they can be attached one to the other.

Step 6-Arrange the petals in a circle FIG. 19. Make sure that the bottoms of petals are abutting FIG. 19. Tack the ends of each petal to the one next to it so that they remain in place FIG. 20.

Figure 21:
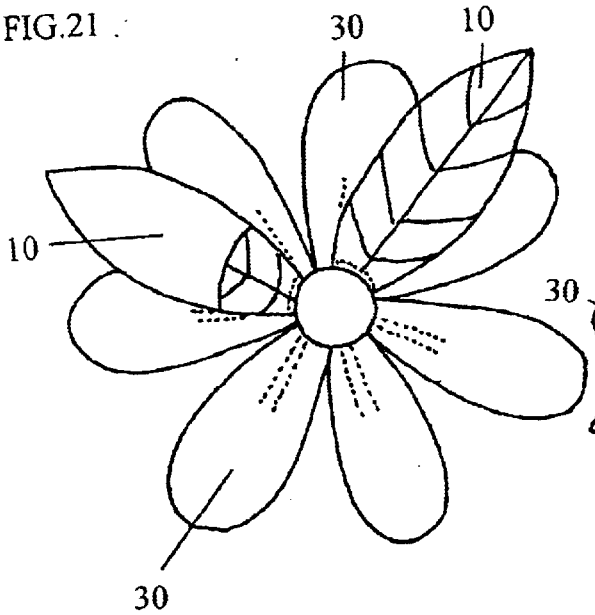
FIG. 21 is a bottom view showing how the leaves are attached under the petals.

Step 7-Attach leaves 10 under the petals so that they remain in place also FIG. 21.

Step 8-Place bottom 32, down and place petals 30, and leaves10, on top, making sure the bottom is centered.

Figure 22:
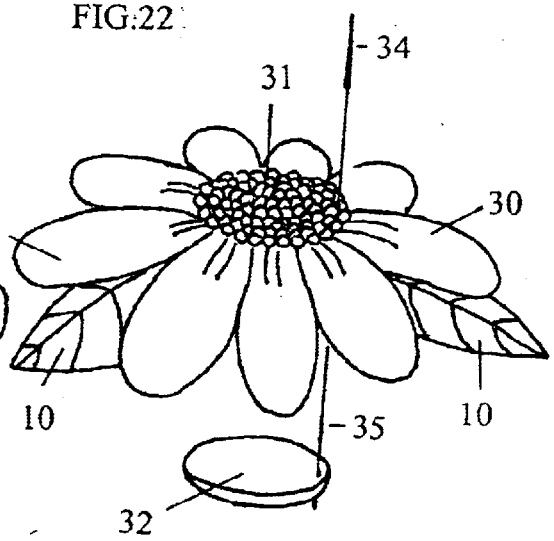
FIG. 22 is a representation of the attachment of all the components necessary to complete the pillow.

Step 9-Place center 31, on top of petals 30, making sure that top center 31 and bottom 32, are aligned. From top to bottom, sew through center, petals, leaves and bottom FIG. 22.

Figure 23:
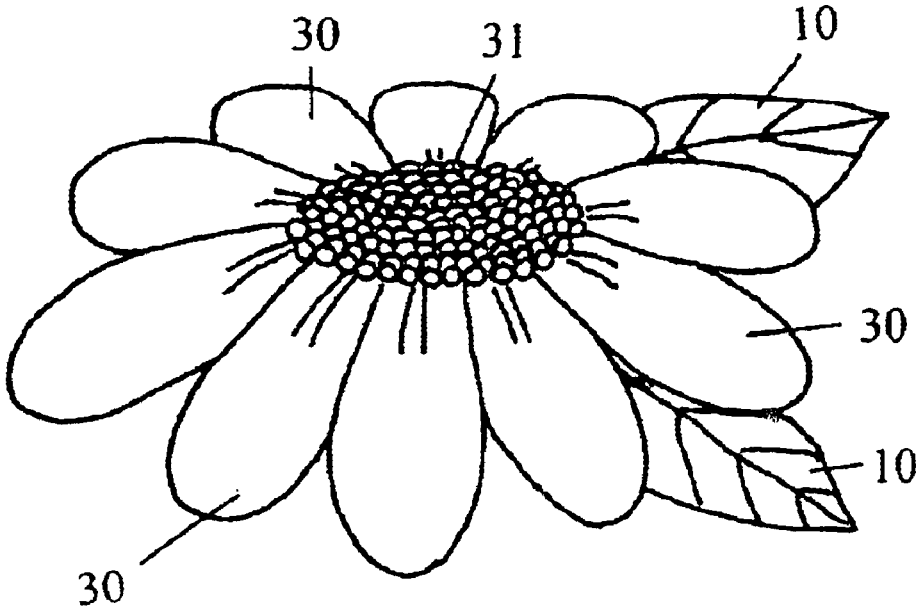
FIG. 23 shows a top view of the completed three-dimensional, multi-petal daisy pillow.
Figure 24:
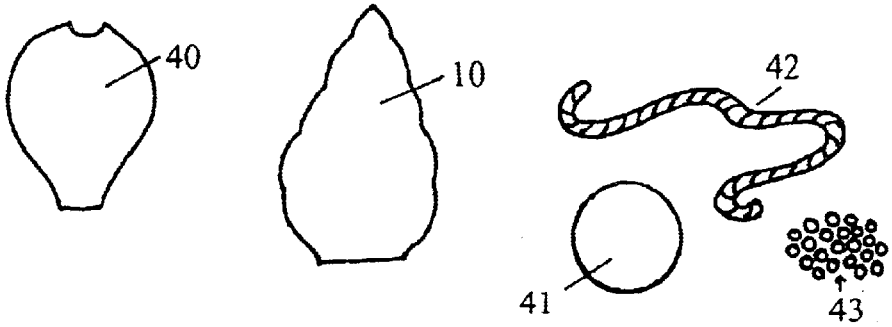
FIG. 24 shows necessary pieces needed to make a dogwood shaped pillow.

An example of a completed three-dimensional multi-petal daisy pillow fabricated in accordance with the method of this invention is illustrated in FIG. 23.

The basic principle used in making a three-dimensional multi-petal flower shaped pillow in the form of a dogwood is as follows:

Step 1-With all the necessary pieces cut out, sew petals 40, leaves10, and bottom 41, leaving an opening for stuffing.

Figure 25:
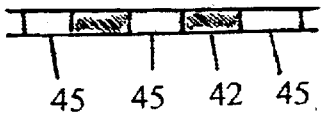
FIG. 25 shows the marking, taping and cutting of the cord.
Figure 26:
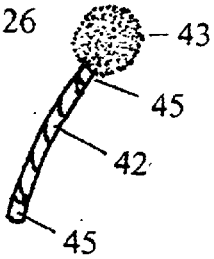
FIG. 26 is a representation of a pom-pom attached to the end of a cut piece of cord.
Figure 27:
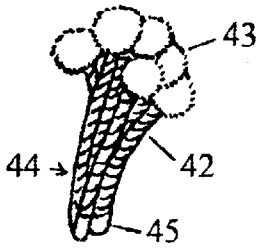
FIG. 27 shows cords attached together in a bundle.
Figure 28:
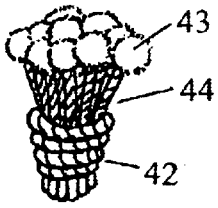
FIG. 28 shows the wrapping and securing of the bundle of cord.

Step 2-To make the middle, measure and cut tan cord 42, into sections of approximately three and a half inches. Place clear tape 45, around marked off sections. Place the tape half way of each marked off section. Cut the cord on the marked and taped section FIG. 25. This will keep the cord from fraying.

Step 3-Using a hot glue gun or other appropriate means, attach a pom-pom 43 on one end of each cut section of cord 42.

Remove tape 45, from the section of the cord under the pom-pom 43.

Attach all the pieces of cord together, to form a bundle 44.

Figure 29:
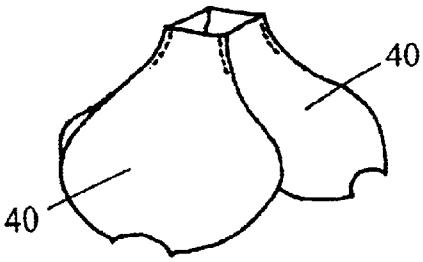
FIG. 29 is a drawing of the way in which the petals should be sewn together.

Wrap another piece of cord 42, securely around the bundle 44, to secure it Step 4-With ends of petals 40, together, from the back side, sew petals 40, together with seams of about one and a half to two inches to form a funnel FIG. 29.

Figure 30:
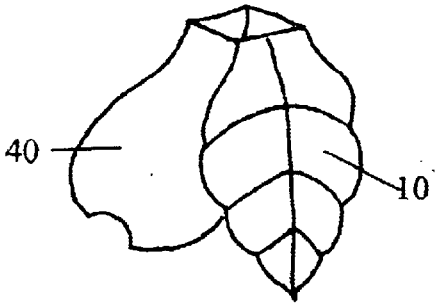
FIG. 30 is a bottom view of how the leaves should be attached to the petals.

Step 5-Two leaves 10, are fashioned in the same manner as described previously, and are attached on either side of the petals 40, on the back side FIG. 30.

Figure 31:
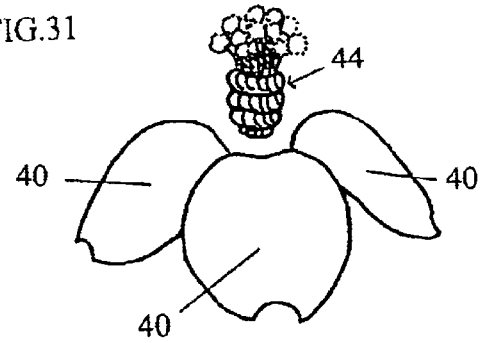
FIG. 31 shows a side view of the bundle of cord being inserted into the middle of the petals to form the center.

Step 6-With flower turned right side up, insert bundle of cord 44 into the middle FIG. 31.

Figure 32:
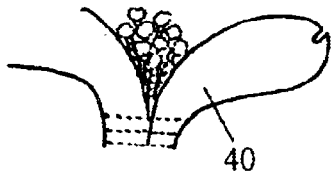
FIG. 32 is a representation of how to secure the petals to the bundle of cord.

Secure middle to petals by sewing around the outside of the petals to the middle FIG. 32.

Figure 33:
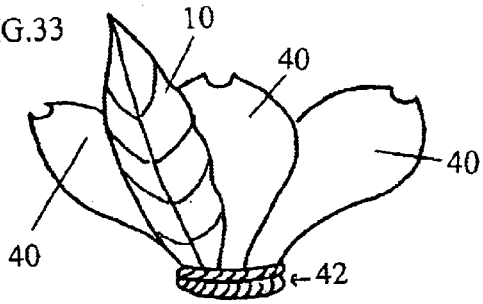
FIG. 33 is a side view of the method used to secure bundle into place.

Step 7-Wrap cord 42 around bottom of petals 40, center 44 and leaves l0,securing them tightly in place FIG. 33.

Figure 34:
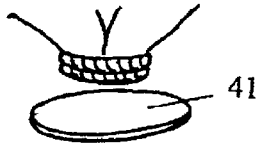
FIG. 34 shows attachment of bottom to the leaves and petals.
Figure 35:
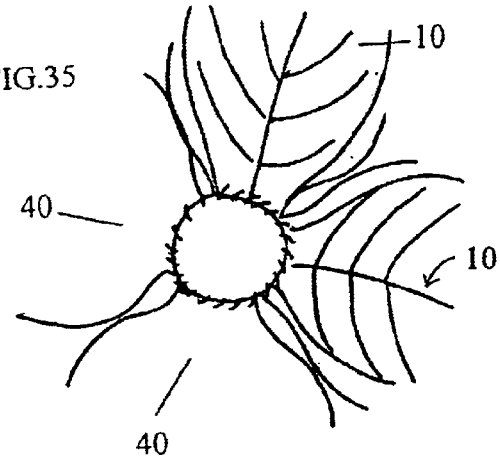
FIG. 35 is a view of the underside of the pillow with bottom sewn into place.

Step 8-Attach bottom 41, by centering it and sewing it into place FIG. 34.

Figure 36:
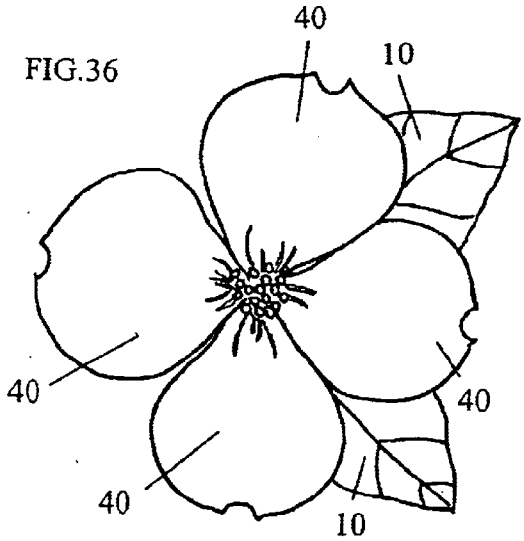
FIG. 36 is a top view of a completed three-dimensional, multi-petal dogwood pillow.
Figure 37:
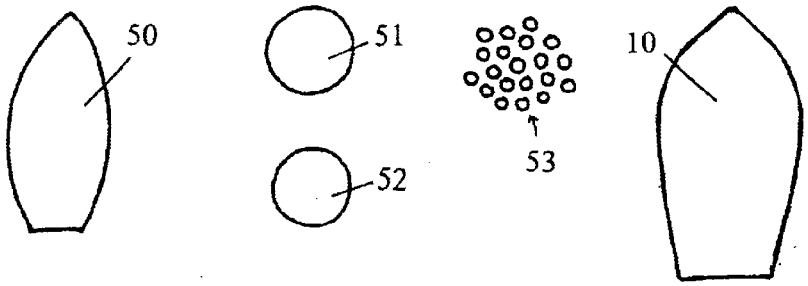
FIG. 37 shows all the necessary pieces needed to make a sunflower pillow.

An example of a three-dimensional multi-petal dogwood pillow fabricated in accordance with the method of this invention is illustrated in FIG. 36.

The basic principle used in making a three-dimensional multi-petal flower shaped pillow in the form of a sunflower is as follows:

Step 1-With all the necessary pieces cut out, sew petals 50, leaves 10, center 51 and bottom 52, leaving an opening for stuffing.

Figure 38:
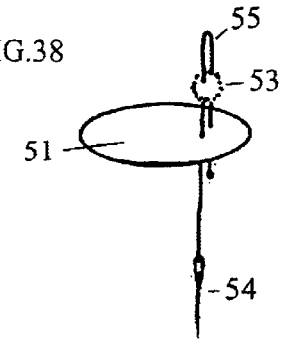
FIG. 38 shows hoe to attach pom-poms to the fabric.
Figure 39:
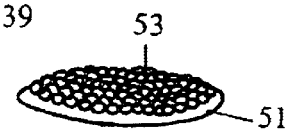
FIG. 39 shows the top center covered with pom-poms leaving necessary room around the edge for sewing.

Step 2-The center is covered with brown pom-poms 53, FIGS. 38–39. This is done by threading a regular sewing needle 54, with brown thread 55, and pushing the needle through the fabric and pom-pom 53, once and back through the pom-pom again and through the fabric. Secure the pom-pom 53, into place by tying a knot at the bottom of the fabric. Repeat this process until the entire center is covered, leaving a space of about one half inch around the edge of the center.

Figure 40:
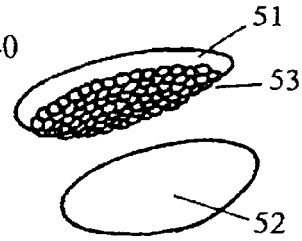
FIG. 40 is a drawing of the center being constructed by placing pom-poms face down onto the matching section of the middle in order to be sewn together.

Step 3-With pom-poms 53, on the inside, sew the two pieces of fabric together FIG. 40.

Turn, stuff and close.

Figure 41:
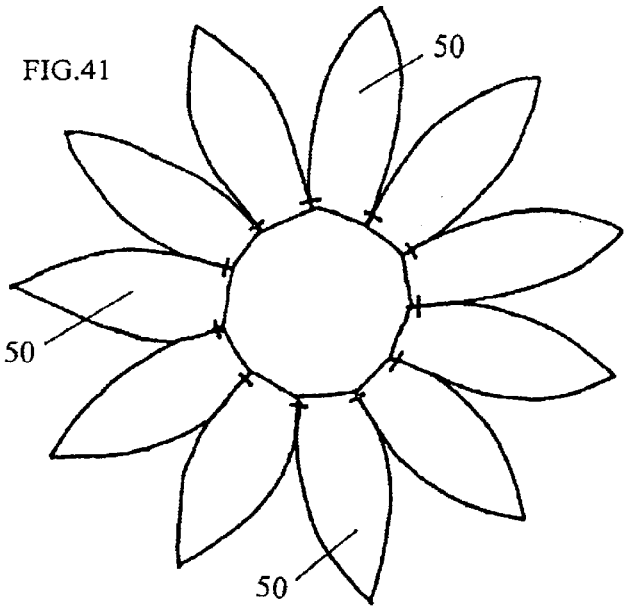
FIG. 41 is a top view of petals placed properly and tacked together.

Step 4-Arrange petals in order according to the shape of a sunflower. Tack the petals 50, together at the bottom to hold them into place FIG. 41.

Figure 42:
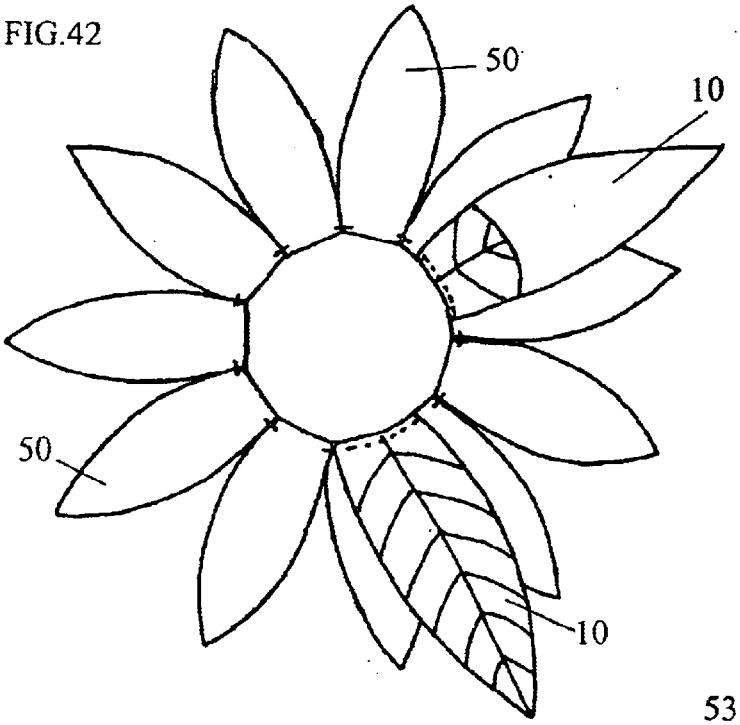
FIG. 42 is a bottom view of leaves placed in position and sewn to the petals.

Step 5-Two leaves 10 are fashioned in the same manner as described previously, and are positioned under the petals and sewn into place FIG. 42.

Step 6-Place bottom 52, under leaves 10, and petals 50, and place center 51 on petals making sure that top51 and bottom 52, are even with one another.

Figure 43:
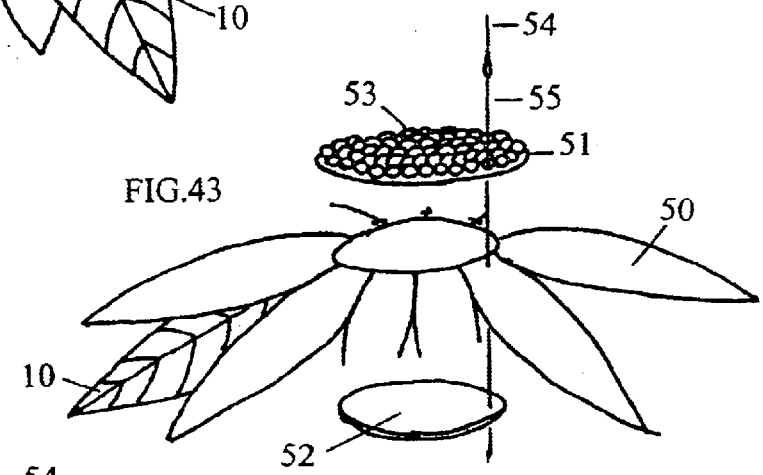
FIG. 43 shows how to place all the parts in order so they can be stitched together.

Step 7-Stitch from top to bottom all the way around the middle, making sure top, petals, leaves and bottom are being sewn together FIG. 43.

Figure 44:
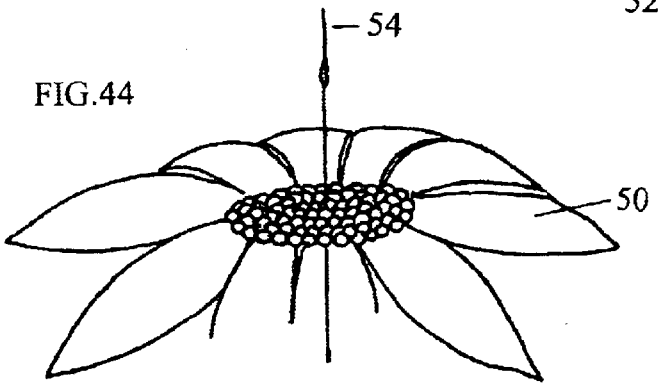
FIG. 44 shows how to make a dip in the center of the pillow.

Step 8-In the very center of the bottom middle, with needle 54, threaded and knot tied in the thread, go up to the top middle and back through to the bottom and pull the thread tightly and secure it to put a dip in the middle of the flower FIG. 44.

Figure 45:
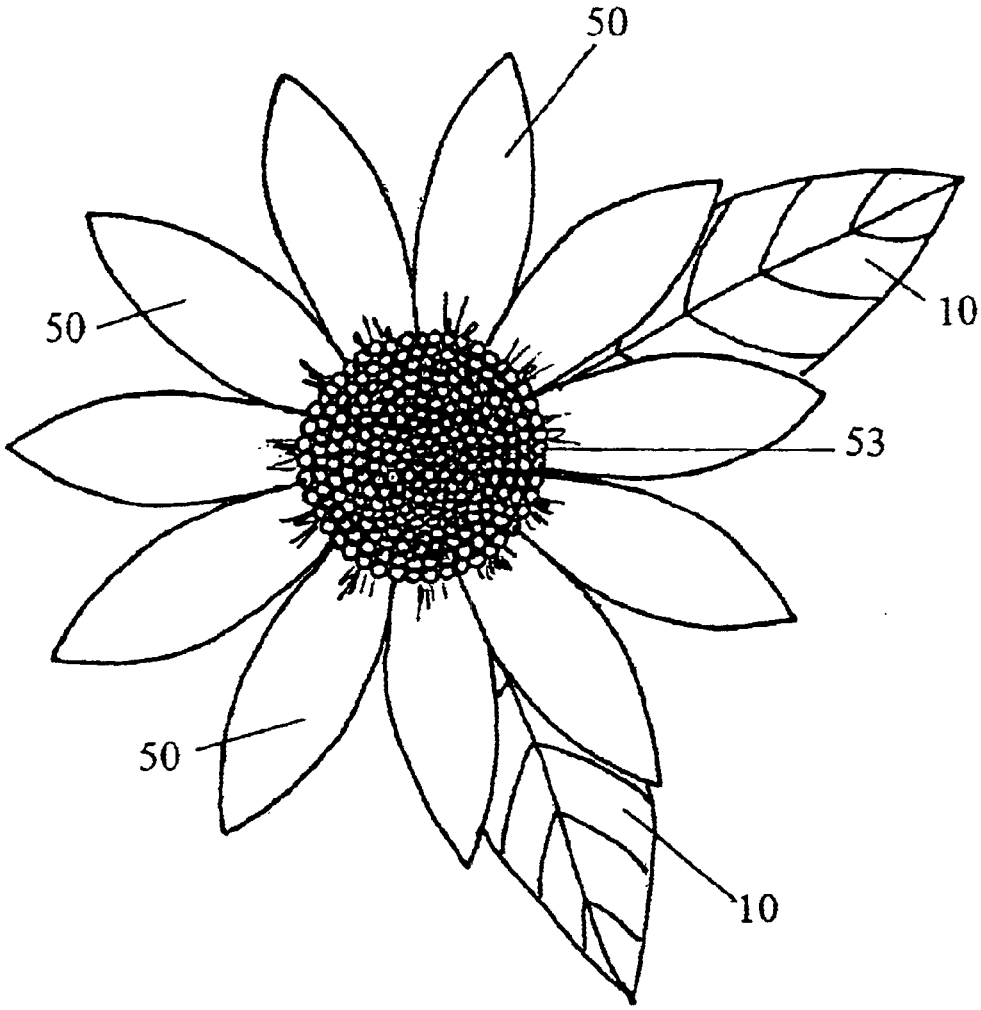
FIG. 45 as a top view of a completed three-dimensional, multi-petal sunflower pillow.
Figure 46:
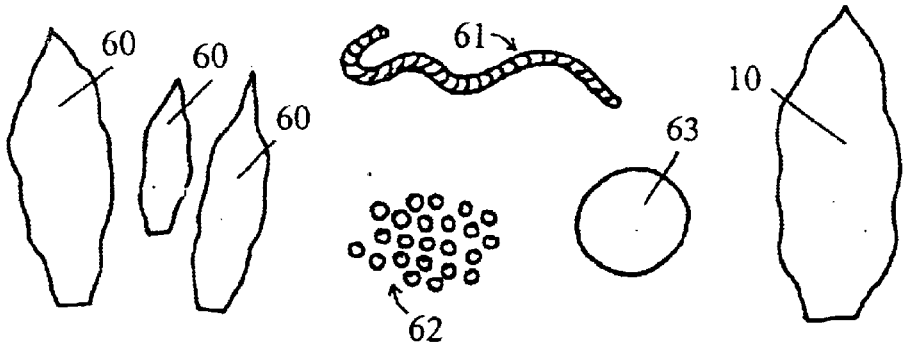
FIG. 46 shows pieces necessary to make a poinsettia pillow.

An example of a three-dimensional multi-petal sunflower pillow fabricated in accordance with the method of this invention is illustrated in FIG. 45.

The basic principle used in making a three-dimensional multi-petal flower shaped pillow in the form of a poinsettia is as follows:

Step 1-Cut out petals 60, leaves 10 and bottom 63. Sew and stuff.

Figure 47:
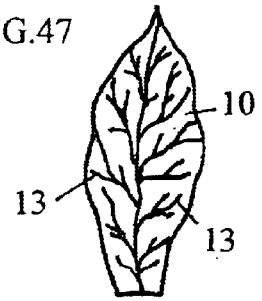

Step 2-Veins 13 on the petals should be sewn to simulate the veins on a poinsettia FIG. 47.

Step 3-Mark green cord 61 into sections of about three and a half inches.

Figure 48:
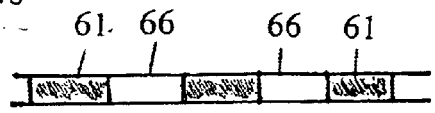
FIG. 48 shows cord wrapped in clear tape.
Figure 49:
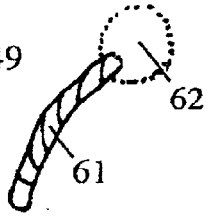
FIG. 49 shows a green pom-pom attached to end of cord.

Step 4-Wrap clear tape 66, around the middle of each marked section FIG. 48. Cut in the middle of each piece of tape. This will keep the cord from fraying at the ends.

Figure 50:
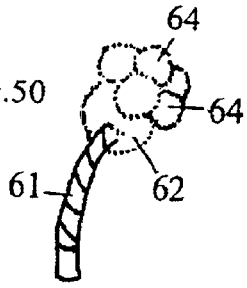
FIG. 50 shows yellow pom-poms attached to green pom-poms.
Figure 51:
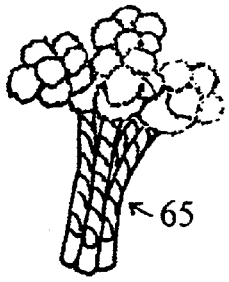
FIG. 51 shows all the cut pieces of cord glued together to form a bundle.

Step 5-Using a hot glue gun or other appropriate means, glue a green pom-pom 62 on one end of each cut piece of cord. On each green pom-pom 62, glue several smaller yellow pom-poms 64, about one half the size of the green pom-poms FIG. 50.

Step 6-Remove tape from under the pom-pom.

Step 7-Attach all the cut pieces of cord 61, together to form a bundle 65.

Figure 52:
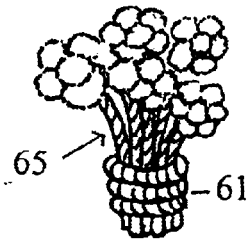
FIG. 52 shows the bundle of cord wrapped and secured.

Wrap the bundle of cord 65, together with another piece of cord 61, to secure it FIG. 52.

Figure 53:
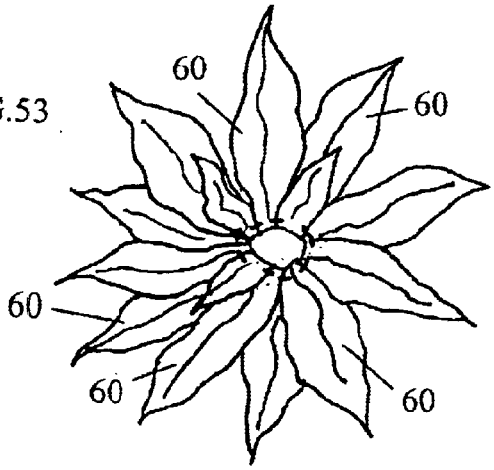
FIG. 53 is a top view of the petals arranged in order and tacked together.

Step 8-Place petals accordingly to form a poinsettia FIG. 53.

Step 9-Tack ends together to hold into place.

Figure 54:
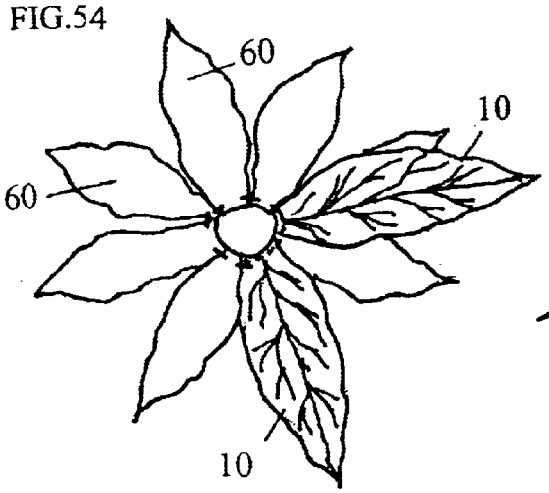
FIG. 54 shows a bottom view of the leaves attached to the petals and sewn into place.

Step 10-Two leaves 10 are fashioned in the same manner as described previously, and are attached to the bottom of petals 60 to secure them into place by tacking them to the petals FIG. 54.

Figure 55:
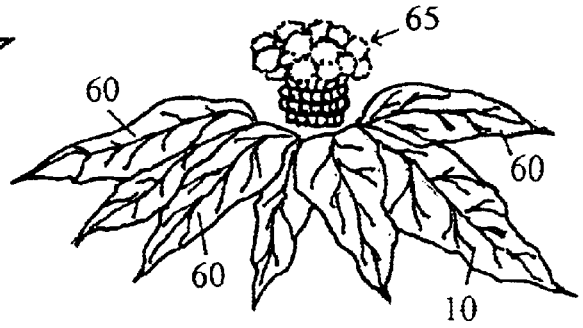
FIG. 55 shows bundle of cord being placed in the middle of the petals to form the center.
Figure 56:
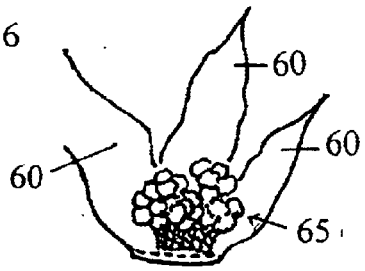
FIG. 56 is a see through version showing how petals are sewn to bundle of cord.
Figure 57:
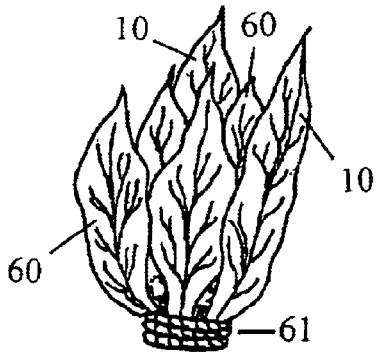
FIG. 57 shows petals, leaves and cord wrapped and secured by another piece of cord.

Step 11-Place bundle of cord 65, in middle of petals 60 FIG. 55. Sew petals 60, to bundle 65 FIG. 56. Using cord 61, tightly wrap bottom of petals 60, leaves10 and cord 61 and secure FIG. 57.

Figure 58:
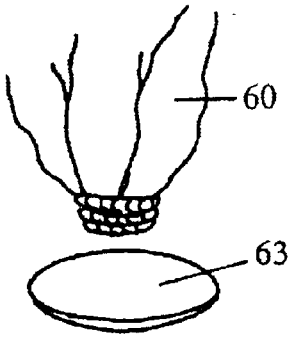
FIG. 58 as a side view of the bottom section being attached to the underside of the pillow.

Step 12-Place bottom 63 under pillow to be attached FIG. 58.

Figure 59:
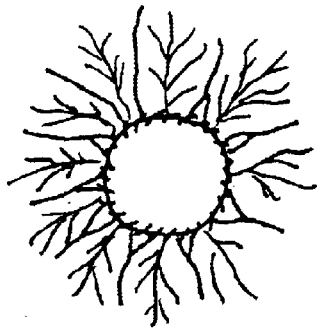
FIG. 59 shows bottom attached to petals and leaves by stitching.

Step 13-Attach bottom 63, by sewing around the edges FIG. 59

Figure 60:
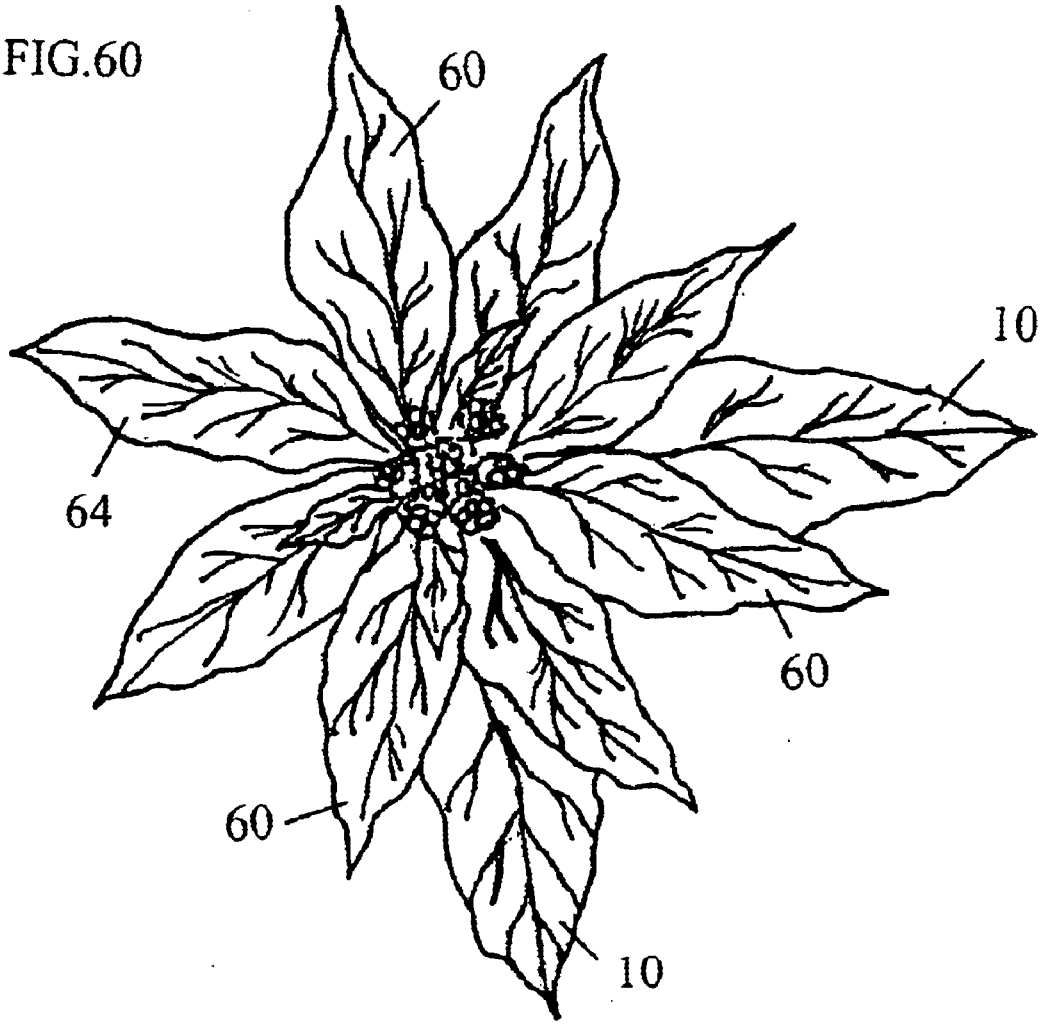
FIG. 60 is a top view of a completed three-dimensional, multi-petal poinsettia pillow.

An example of a three-dimensional multi-petal pillow in the shape of a poinsettia fabricated in accordance with the method of this invention is illustrated in FIG. 60.

Figure 61:
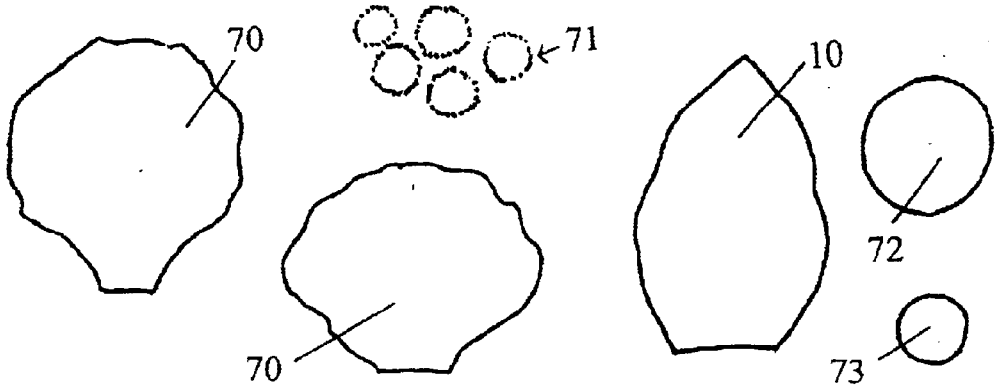
FIG. 61 shows the necessary pieces needed to make a pansy pillow.

The basic principle used in making a three-dimensional multi-petal flower shaped pillow in the form of a pansy is as follows:

Step 1-Cut out the necessary pieces needed to make this pillow FIG. 61.

Figure 62:
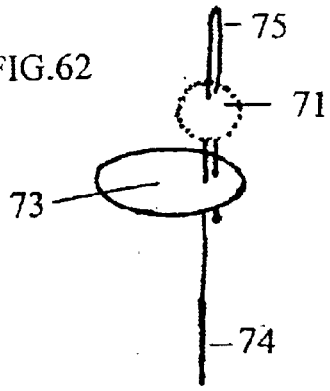
FIG. 62 shows how to attach the pom-poms to one side of the fabric that will be used to make the middle section.
Figure 63:
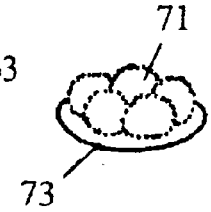
FIG. 63 is a drawing of the pom-poms attached to the center.

Step 2- Attach black pom-poms 71 to the fabric by threading needle and tying a knot in the end of thread 75. From bottom 73 of the fabric 73, run the needle 74 up through pom-pom 71 and back through pom-pom 71 again and through fabric 73 FIG. 62. Secure pom-poms 71 to fabric 73 FIG. 63.

Figure 64:
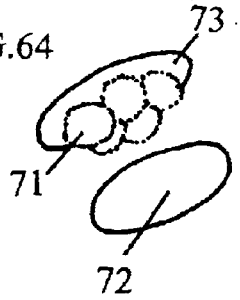
FIG. 64 is a schematic representation of the completion of the center.

Step 3-With pom-poms 71 turned down, sew both pieces of fabric, turn and stuff FIG. 64.

Step 4-Sew, turn and stuff petals 70, and bottom.

Figure 65:
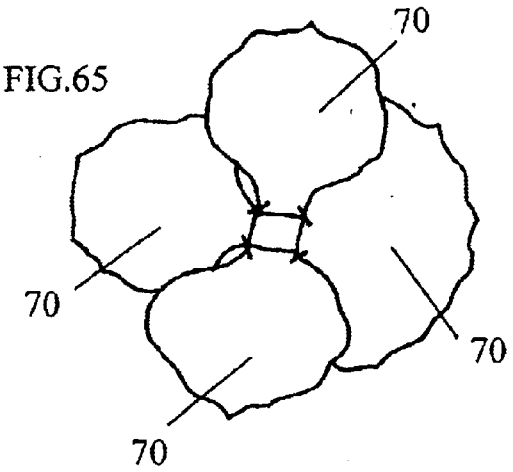
FIG. 65 shows a top view of petals tacked into place
Figure 66:
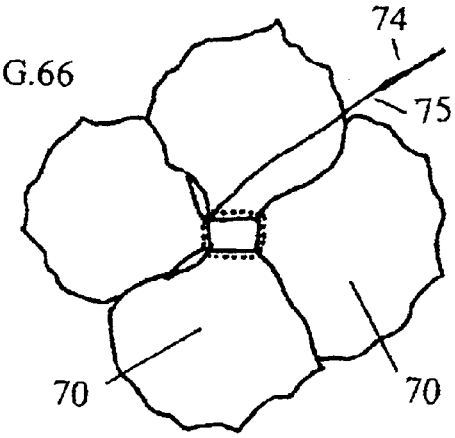
FIG. 66 shows the thread being run through the petals to draw them tight.

Step 5-Tack petals 70, together at the ends to hold them into place FIG. 65. Next, using the upholstery thread 75, run a seam all the way around the bottom of petals 70, and draw the middle together FIG. 66.

Figure 67:
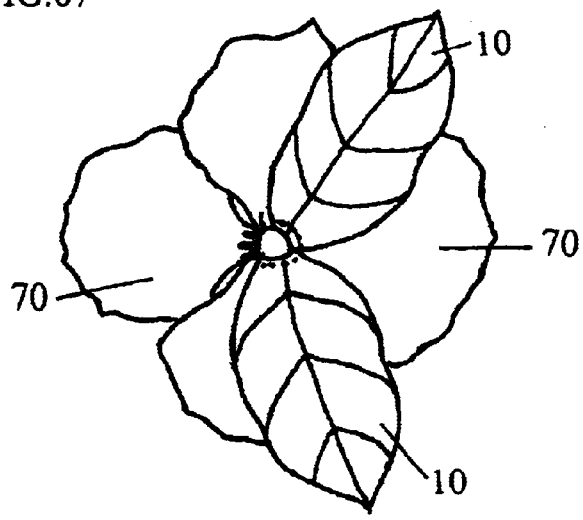
FIG. 67 is a bottom view of the leaves attached to the petals.

Step 6-Two leaves 10, are fabricated in the same manner as described previously, and are attached to the petals 70 at the center FIG. 67.

Figure 68:
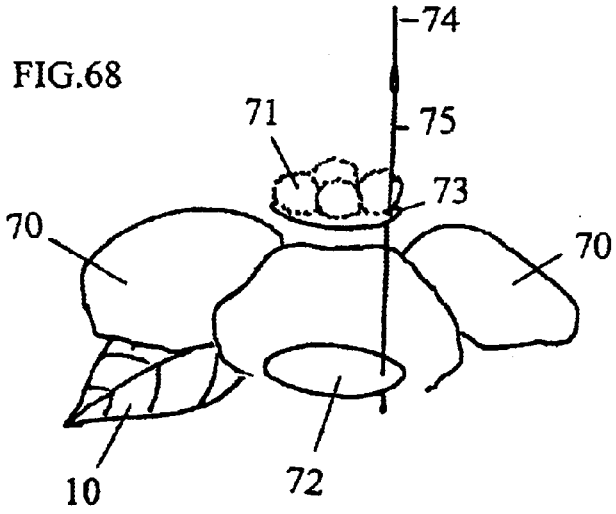
FIG. 68 shows how to complete the pillow by attaching all parts together.

Step 7-Align top center 73 and bottom center 72 and sew from top to bottom making sure that all pieces are being sewn together FIG. 68.

Figure 69:
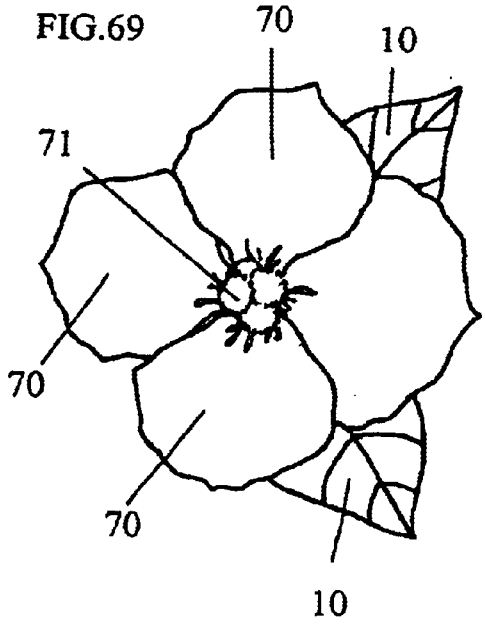
FIG. 69 is a top view of a three-dimensional, multi-petal pansy pillow.

An example of a three-dimensional multi-petal pillow in the shape of a pansy fabricated in accordance with the method of this invention is illustrated in FIG. 69.

Figure 70:
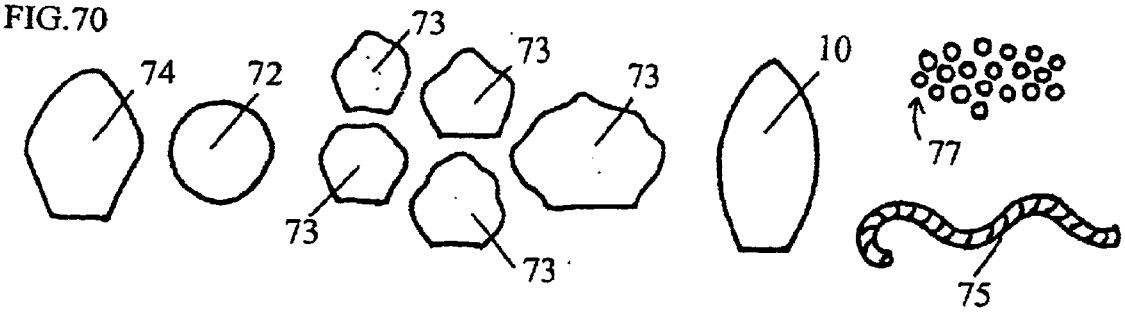
FIG. 70 shows the pieces necessary to make a magnolia pillow.
Figure 71:
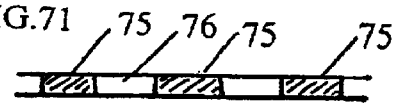
FIG. 71 shows the cord marked off into three-inch sections.

The basic principle used in making a three-dimensional multi-petal flower shaped pillow in the form of a magnolia is as follows:

Step 1-With necessary pieces cut out FIG. 70, sew and stuff bottom 72, petals 73, center 74 and leaves 10.

Step 2- Mark brown cord 75 into sections of about three inches. Wrap clear tape 76 around each marked section making sure the marked spot is in the middle of the tape 71.

Figure 72:
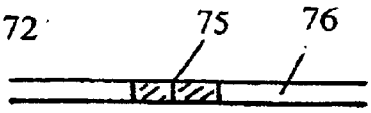
FIG. 72 shows where to cut the tape on the marked cord.

Step 3-Cut cord 75 on the marked spot FIG. 72. This will keep the cord from fraying.

Figure 73:
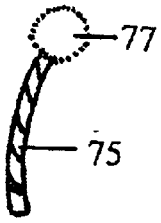
FIG. 73 shows the attachment of a pom-pom on the end of a cut piece of cord.

Step 4-Using a hot glue gun or other appropriate means, attach a brown pom-pom 77 on one taped end of each cut section 75 FIG. 73. Remove the tape under the pom-pom.

Figure 74:
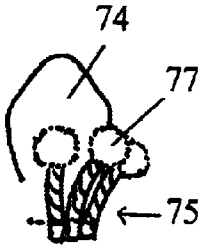
FIG. 74 shows how to attach cords to the center.

Step 5-Sew all the pieces of cut cord 75 with pom-poms 77 attached to center 74 FIG. 74. Make sure the cord is sewn all the way around the center.

Figure 75:
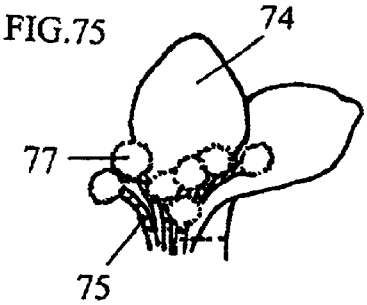
FIG. 75 shows how to sew the petals around the center.

Step 6-Start attaching petals 73 to center 74 by sewing them on one at a time FIG. 75.

The petals are arranged to simulate the petals of a magnolia blossom.

Figure 76:
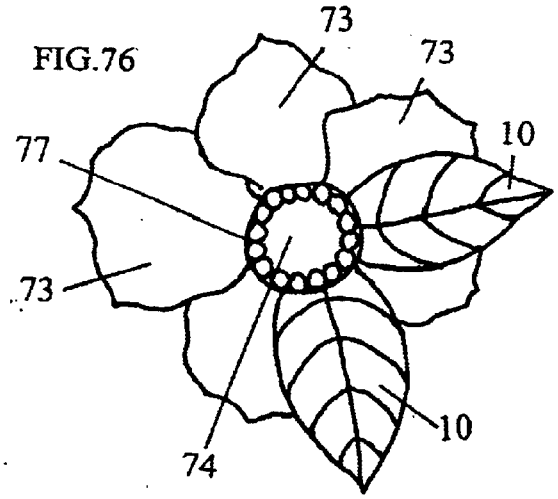
FIG. 76 is a bottom view of how the leaves should be arranged and attached to the petals and center.

Step 7-Two leaves 10 are fabricated in the same manner as described previously, and are attached to either side under petals 73 FIG. 76.

Figure 77:
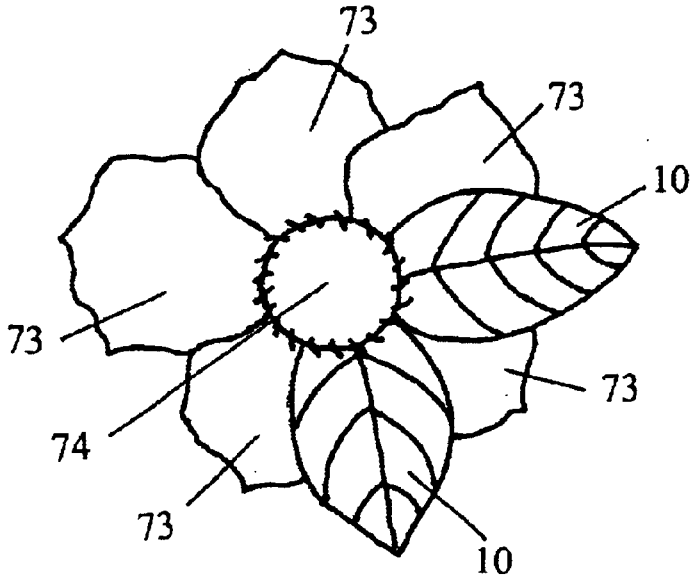
FIG. 77 shows how to complete the pillow by attaching the bottom to the leaves and petals.

Step 8-Attach bottom to leaves and petals by sewing it on FIG. 77.

Figure 78:
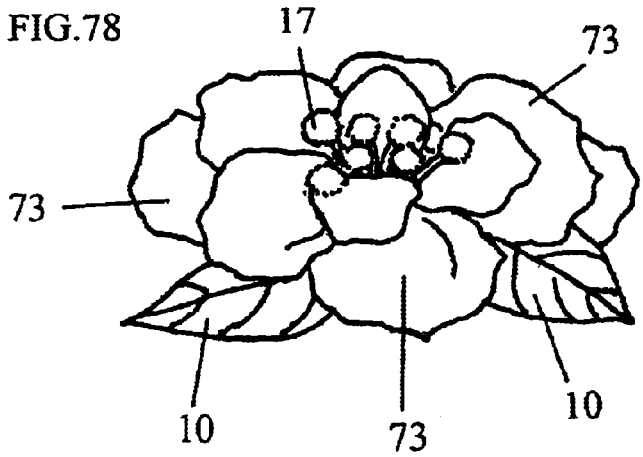
FIG. 78 shows a side view of a completed three-dimensional, multi-petal magnolia pillow.

An example of a three-dimensional multi-petal pillow in the shape of a magnolia, fabricated in accordance with the method of this invention is illustrated in FIG. 78.

It will be further understood that the method of this invention is not to be limited to the precise form disclosed in the preferred embodiments, but may be modified without departing from the scope of the invention as defined in the appended claims.

I claim:

1. A method of fabricating a three-dimensional, multi-petal flower-shaped pillow/cushion comprising the steps of fabricating a center portion simulating the shape of the flower head of the flower being fabricated;

fabricating a multiplicity of petals simulating the shape of the petals of the flower being fabricated;

fabricating a plurality of leaves simulating the shape of the leaves of the flower being fabricated;

fabricating a bottom portion having a shape and dimension approximating that of said center portion;

stuffing each piece to simulate the three-dimensional shape of the corresponding parts of the natural flower being simulated;

attaching said multiplicity of petals to said center portion to produce the shape of the flower being simulated;

attaching said plurality of leaves to said center portion; and attaching said bottom portion to the underside of said center portion to create a smooth neat appearance.

2. A method of fabricating a three-dimensional, multi-petal flower-shaped pillow/cushion according to claim 1, wherein one of the plurality of leaves is comprised of three segments, a top section, bottom section and pouch section, said top and bottom sections being of the same size and dimensions, said pouch section having the same peripheral shape as said top and bottom sections, but having a shorter length than said other sections, thereby forming an open pocket between said bottom section and said pouch section, and fastening means whereby to enclose said pocket.

3. A method of fabricating a three-dimensional, multi-petal flower-shaped pillow/cushion according to claim 2, wherein veins are sewn into said leaves to simulate the veins in the leaves of the flower being simulated.

4. The method of fabricating a three-dimensional, multi-petal flower-shaped pillow/cushion according to claim 1, wherein the individual petals are formed in the shape of rose petals and wherein the individual leaves are formed in the shape of the leaves of a rose, resulting in a pillow/cushion having the three-dimensional appearance of a rose.

5. The method of fabricating a three-dimensional, multi-petal flower-shaped pillow/cushion according to claim 1, wherein the top side of said center portion is covered in yellow pom-poms to simulate the center of a daisy, said multiplicity of petals are fabricated to simulate the petals of a daisy, said leaves are fabricated to simulate the leaves of a daisy, resulting in a pillow/cushion having the three-dimensional appearance of a daisy.

6. The method of fabrication a three-dimensional, multi-petal flower-shaped pillow/cushion according to claim 1, wherein said center portion is fabricated to simulate the stamen of a dogwood blossom, comprised of appropriately colored cord and pom-poms, said multiplicity of petals are fabricated to simulate the petals of a dogwood blossom, said leaves are fabricated to simulate the leaves of a dogwood blossom, resulting in a pillow/cushion having the three-dimensional appearance of a dogwood blossom.

7. A method of fabricating a three-dimensional, multi-petal flower-shaped pillow/cushion according to claim 1, wherein the top side of said center portion is covered in pom-poms which simulate the center of a sunflower, said multiplicity of petals are fabricated to simulate the petals of a sunflower, said leaves are fabricated to simulate the leaves of a sunflower, resulting in a pillow/cushion having the three-dimensional appearance of a sunflower.

8. A method of fabricating a three-dimensional, multi-petal flower-shaped pillow/cushion according to claim 1, wherein said center portion is fabricated to simulate the stamen of a poinsettia, comprised of appropriately colored cord and pom-poms, said multiplicity of petals are fabricated to simulate the petals of a poinsettia, said leaves are fabricated to simulate the leaves of a poinsettia, resulting in a pillow/cushion having the three-dimensional appearance of a poinsettia.

9. A method of fabricating a three-dimensional, multi-petal flower-shaped pillow/cushion according to claim 1, wherein said center portion is covered in appropriately colored pom-poms to simulate the center of a pansy, said multiplicity of petals are fabricated to simulate the petals of a pansy, said leaves are fabricated to simulate the leaves of a pansy, resulting in a pillow/cushion having the three-dimensional appearance of a pansy.

10. A method of fabricating a three-dimensional, multi-petal flower-shaped pillow/cushion according to claim 1, wherein said center portion is fabricated to simulate the stamen of a magnolia blossom, comprised of appropriately colored pom-poms, said multiplicity of petals are fabricated to simulate the petals of a magnolia blossom, said leaves are fabricated to simulate the leaves of a magnolia blossom, resulting in a pillow/cushion having the three-dimensional appearance of a magnolia blossom.

* * * * *